US005217263A

United States Patent [19]

Peterson

[11] Patent Number: 5,217,263

[45] Date of Patent: Jun. 8, 1993

[54] SCREEN CLIP

[76] Inventor: Sofia A. Peterson, 1240 SE. 4th Ct., Deerfield Beach, Fla. 33441

[21] Appl. No.: 882,039

[22] Filed: May 13, 1992

[51] Int. Cl.[5] ..... E05C 5/02

[52] U.S. Cl. ..... 292/112; 292/DIG. 38

[58] Field of Search ..... 49/463, 466; 160/369, 160/371; 292/103, 107, 113, 17, DIG. 38

[56] References Cited

U.S. PATENT DOCUMENTS

| | | | |
|---|---|---|---|
| 1,455,625 | 5/1923 | Langenau | 292/103 X |
| 1,641,681 | 9/1927 | Kircher | 292/113 X |
| 2,222,293 | 11/1940 | Hagstrom | 292/113 |
| 2,394,870 | 2/1946 | Orlin | 49/463 X |
| 2,711,789 | 6/1955 | Boyle et al. | 49/463 X |
| 3,063,524 | 11/1962 | Kessley | 49/463 X |
| 3,734,551 | 5/1973 | Hughes et al. | 292/17 |
| 4,284,299 | 8/1981 | Kelly | 292/DIG. 38 X |
| 4,705,308 | 11/1987 | Bishing | 292/113 X |
| 5,127,684 | 7/1992 | Klotz et al. | 292/DIG. 38 X |

*Primary Examiner*—Richard E. Moore

[57] ABSTRACT

A quick release clip molded of either aluminum or plastic for mounting on a window or door frame for securing a screen. Six such clips are equally spaced around the frame for latching cooperation with the screen. The clip is formed of a base secured to the frame by a press-fitting or a screw, a lever pivoted to one edge of the base and a clamp pivoted to a surface of the lever. Integral male and female cooperating snap parts on the lever and the base, respectively, secure the clip in latching position.

1 Claim, 1 Drawing Sheet

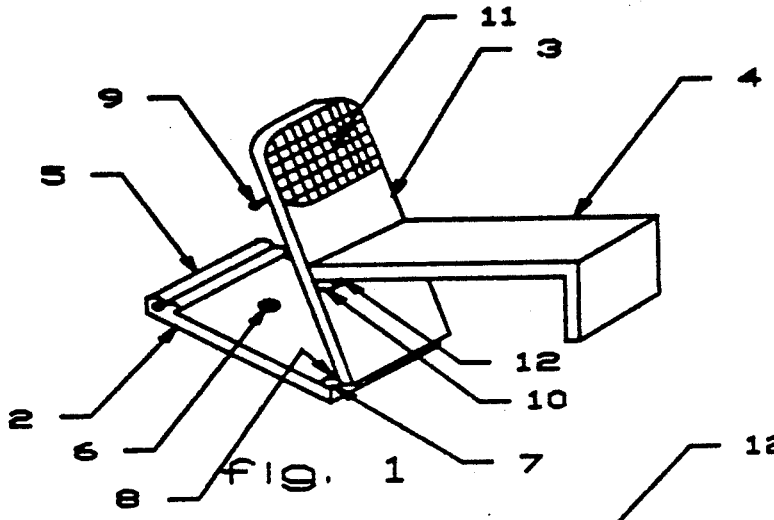
fig. 1
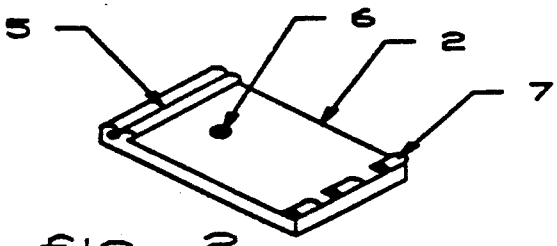
fig. 2
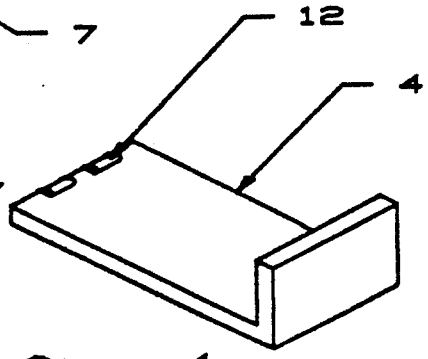
fig. 4
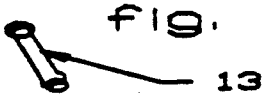
fig. 5
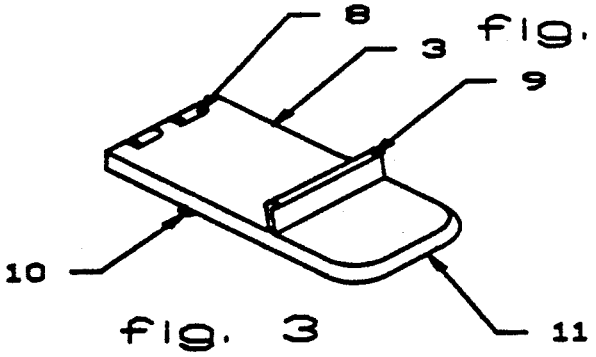
fig. 3
fig. 6
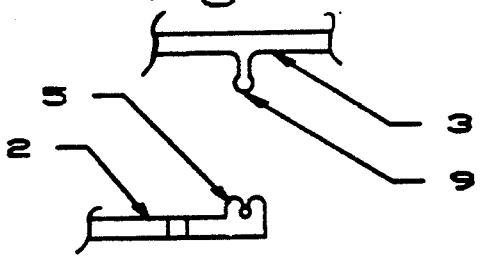
fig. 7

SCREEN CLIP

BACKGROUND OF THE INVENTION

The invention describes a quick-release screen clip designed specifically to retain a window or door screen against its frame. The invention is used as original equipment for new window or door frames or to replace existing screen clips. The design consists of three aluminum or plastic pieces; the base, the lever and the clamp which are joined together by hinges in two locations.

DESCRIPTIONS OF PRIOR DESIGNS

Existing screen clip designs require the user to remove each clip retaining screw every time the screen must be removed from the frame. Considering that most window screens use six clips, removing such a screen can be time-consuming. With the present design, no tools are required. The user simply unsnaps a lever for each clip installed permanently to the frame

BRIEF DESCRIPTION OF THE DRAWINGS

FIG. 1 represents the completed assembly of the quick-release screen clip.

FIG. 2 represents the hinged base.

FIG. 3 represents the lever shown rotated 180 degrees from its position in FIG. 1.

FIG. 4 represents the clamp.

FIG. 5 represents a press fitting for securing the screen clip to the frame.

FIG. 6 represents a broken view of the lever including a side view of a male snap part.

FIG. 7 represents a broken view of the base of the screen clip including a side view of a female snap part that cooperates with the FIG. 6 part.

DETAILED DESCRIPTION

The invention is typically installed in six positions equally spaced around any window or door frame that accommodates a screen. For this description, one clip is referenced. If the clip is used as original equipment, a press fitting 13 is inserted through the hole 6 in the base 2 and seats in the frame. If the invention is replacing existing screen clips, the screw that secured the existing clip is used to secure the base of this design. The base is molded with an existing hole. Part 5 on base 2 acts as the female part of the snap assembly. This snap assembly keeps the lever 3 secured in latching position. The male part of the snap assembly on lever 3 is indicated by 9. The base 2 and lever 3 are joined together by hinge part 7 and hinge part 8 with a hinge pin.

The outside end of the layer 3 uses an engraved cross-hatch pattern 11 to keep the user's thumb from slipping when the lever is pressed into the snapped position. The outside of lever 3 contains a second hinge part 10 and clamp 4 contains a cooperating hinge part 12 which are pinned together. Base 2 is molded together with female part 5 and hinge part 7. Lever 3 is molded together with hinge part 8, male snap part 9, and hinge part 10. Clamp 4 is molded together with hinge part 12.

The invention is constructed from light-weight aluminum or plastic that can withstand years to use.

The low cost of building this design ensures an inexpensive way for the end user to improve window and door screen handling.

I claim:

1. A quick-release screen clip comprising a rectangular base, apertured for securement to a window or door frame and, including, as integral molded parts projecting from a face thereof, a hinge part along one edge and a female part along the opposite edge thereof; a rectangular lever including as integral molded parts projecting from a face thereof, a cooperating hinge part along one edge thereof, operatively connected to the hinge part of said base, and a male snap part shaped and located for snap cooperation with said female part of said base; said lever further including as an integrally molded part thereof and on the opposite face thereof, a third hinge part located between said female part and said lever hinge part; and a rectangular clamp including as integral molded parts projecting from a face thereof, a fourth hinge part along one edge thereof and cooperating with said third hinge part, and a rectangular latching end part located along an opposite edge thereof, for securing the screen.

* * * * *